US008978772B2

(12) United States Patent
Yates et al.

(10) Patent No.: US 8,978,772 B2
(45) Date of Patent: Mar. 17, 2015

(54) CASING HANGER LOCKDOWN WITH CONICAL LOCKDOWN RING

(75) Inventors: Chad Eric Yates, Houston, TX (US); David L. Ford, Houston, TX (US); Daniel Caleb Benson, Spring, TX (US)

(73) Assignee: Vetco Gray Inc., Houston, TX (US)

( * ) Notice: Subject to any disclaimer, the term of this patent is extended or adjusted under 35 U.S.C. 154(b) by 534 days.

(21) Appl. No.: 13/313,160

(22) Filed: Dec. 7, 2011

(65) Prior Publication Data

US 2013/0146306 A1 Jun. 13, 2013

(51) Int. Cl.

| | |
|---|---|
| ***E21B 33/043*** | (2006.01) |
| ***E21B 33/035*** | (2006.01) |
| ***E21B 7/128*** | (2006.01) |
| ***E21B 23/01*** | (2006.01) |
| ***E21B 33/04*** | (2006.01) |

(52) U.S. Cl.

CPC ..... *E21B 33/0422* (2013.01); *E21B 33/04* (2013.01)

USPC ..... 166/348; 166/75.14; 166/360; 166/368; 166/382

(58) Field of Classification Search

USPC ..... 166/348, 360, 368, 382, 75.14

See application file for complete search history.

(56) References Cited

U.S. PATENT DOCUMENTS

| | | | | | |
|---|---|---|---|---|---|
| 2,350,867 | A | * | 6/1944 | Bean et al. | 285/96 |
| 2,683,046 | A | * | 7/1954 | Allen | 285/123.8 |
| 2,689,139 | A | * | 9/1954 | Jones et al. | 285/123.8 |
| 2,690,344 | A | * | 9/1954 | Allen | 285/123.7 |
| 3,195,638 | A | * | 7/1965 | Le Ronax | 166/368 |
| 3,209,829 | A | * | 10/1965 | Haeber | 166/348 |
| 3,211,223 | A | * | 10/1965 | Hoch | 166/356 |
| 3,299,951 | A | * | 1/1967 | Todd | 166/348 |
| 3,299,954 | A | * | 1/1967 | Williams et al. | 166/298 |
| 3,330,341 | A | * | 7/1967 | Jackson, Jr. et al. | 166/344 |
| 3,367,002 | A | * | 2/1968 | Johnson | 175/423 |
| 3,944,273 | A | * | 3/1976 | Ahlstone | 294/86.1 |
| 4,131,287 | A | * | 12/1978 | Gunderson et al. | 277/328 |
| 4,385,663 | A | * | 5/1983 | Hutchison | 166/378 |
| 4,388,971 | A | * | 6/1983 | Peterson | 166/387 |
| 4,402,535 | A | * | 9/1983 | Bridges | 285/123.11 |
| 4,460,042 | A | * | 7/1984 | Galle, Jr. | 166/217 |
| 4,540,053 | A | * | 9/1985 | Baugh et al. | 166/348 |
| 4,550,782 | A | * | 11/1985 | Lawson | 166/382 |
| 4,595,053 | A | * | 6/1986 | Watkins et al. | 166/209 |
| 4,595,063 | A | * | 6/1986 | Jennings et al. | 166/382 |

(Continued)

OTHER PUBLICATIONS

U.S. Appl. No. 13/172,537, filed Jun. 29, 2011, by Yates, et al.

(Continued)

*Primary Examiner* — Matthew Buck
*Assistant Examiner* — Edwin Toledo-Duran
(74) *Attorney, Agent, or Firm* — Bracewell & Giuliani LLP

(57) ABSTRACT

A seal seals an annulus in a subsea assembly between a wellhead and a casing hanger landed on a shoulder within a bore of the wellhead. The seal includes a casing hanger seal ring disposed within the annulus. The seal ring engaged with an inner diameter surface of the wellhead, and engaged with an outer diameter surface of the casing hanger so that the seal ring prevents flow through the annulus. A nose ring is secured to a lower end of the seal ring so that, when the seal ring is energized, a conical surface of the nose ring engages a mating conical profile formed in the inner diameter surface portion of the wellhead and the nose ring engages a surface opposite the conical surface with a substantially smooth outer diameter surface portion of the casing hanger to limit upwards axial movement of the casing hanger.

20 Claims, 4 Drawing Sheets

(56) References Cited

U.S. PATENT DOCUMENTS

| | | | | | |
|---|---|---|---|---|---|
| 4,597,448 | A | * | 7/1986 | Baugh | 166/348 |
| 4,630,680 | A | * | 12/1986 | Elkins | 166/342 |
| 4,664,187 | A | * | 5/1987 | Weinberg | 166/115 |
| 4,665,979 | A | * | 5/1987 | Boehm, Jr. | 166/208 |
| 4,691,780 | A | * | 9/1987 | Galle et al. | 166/348 |
| 4,714,111 | A | * | 12/1987 | Brammer | 166/182 |
| 4,742,874 | A | * | 5/1988 | Gullion | 166/348 |
| 4,759,409 | A | * | 7/1988 | Gullion | 166/348 |
| 4,790,572 | A | * | 12/1988 | Slyker | 285/123.12 |
| 4,815,770 | A | * | 3/1989 | Hyne et al. | 285/123.12 |
| 4,823,871 | A | * | 4/1989 | McEver et al. | 166/182 |
| 4,900,041 | A | * | 2/1990 | Hopkins et al. | 277/328 |
| 4,903,992 | A | * | 2/1990 | Jennings et al. | 285/24 |
| 4,928,769 | A | * | 5/1990 | Milberger et al. | 166/382 |
| 4,932,472 | A | * | 6/1990 | Boehm, Jr. | 166/208 |
| 4,949,786 | A | * | 8/1990 | Eckert et al. | 166/208 |
| 4,949,792 | A | * | 8/1990 | Rubbo et al. | 166/382 |
| 5,020,593 | A | * | 6/1991 | Milberger | 166/208 |
| 5,031,695 | A | * | 7/1991 | Cain et al. | 166/75.14 |
| 5,060,724 | A | * | 10/1991 | Brammer et al. | 166/208 |
| 5,094,297 | A | | 3/1992 | Bridges | |
| 5,127,478 | A | * | 7/1992 | Miller | 166/348 |
| 5,174,376 | A | * | 12/1992 | Singeetham | 166/208 |
| 5,247,997 | A | * | 9/1993 | Puccio | 166/348 |
| 5,307,879 | A | * | 5/1994 | Kent | 166/382 |
| 5,325,925 | A | * | 7/1994 | Smith et al. | 166/387 |
| 5,341,885 | A | * | 8/1994 | Bridges | 166/382 |
| 5,487,427 | A | * | 1/1996 | Curington | 166/382 |
| 5,544,706 | A | * | 8/1996 | Reed | 166/379 |
| 5,566,762 | A | * | 10/1996 | Braddick et al. | 166/382 |
| 6,035,938 | A | * | 3/2000 | Watkins | 166/345 |
| 6,234,252 | B1 | * | 5/2001 | Pallini et al. | 166/345 |
| 6,302,217 | B1 | * | 10/2001 | Kilgore et al. | 166/382 |
| 6,367,558 | B1 | * | 4/2002 | Borak, Jr. | 166/387 |
| 6,510,895 | B1 | * | 1/2003 | Koleilat et al. | 166/208 |
| 6,672,396 | B1 | * | 1/2004 | Marroquin et al. | 166/348 |
| 7,040,407 | B2 | * | 5/2006 | Jennings et al. | 166/348 |
| 7,150,323 | B2 | * | 12/2006 | Ford | 166/348 |
| 7,159,669 | B2 | * | 1/2007 | Bourgoyne et al. | 166/382 |
| 7,540,329 | B2 | * | 6/2009 | Fay et al. | 166/382 |
| 7,559,366 | B2 | * | 7/2009 | Hunter et al. | 166/217 |
| 7,581,595 | B2 | * | 9/2009 | Fay et al. | 166/382 |
| 7,743,832 | B2 | * | 6/2010 | Shaw et al. | 166/338 |
| 7,762,319 | B2 | * | 7/2010 | Nelson | 166/84.1 |
| 7,798,231 | B2 | * | 9/2010 | Ford | 166/337 |
| 7,861,789 | B2 | * | 1/2011 | Nelson | 166/348 |
| 8,186,426 | B2 | * | 5/2012 | Nelson | 166/88.3 |
| 8,205,670 | B2 | * | 6/2012 | Nelson | 166/84.1 |
| 8,322,428 | B2 | * | 12/2012 | Jennings | 166/338 |
| 8,347,966 | B2 | * | 1/2013 | Nguyen et al. | 166/345 |
| 2001/0001419 | A1 | * | 5/2001 | Allen | 166/368 |
| 2005/0067168 | A1 | * | 3/2005 | Baird | 166/380 |
| 2008/0061510 | A1 | * | 3/2008 | Li et al. | 277/300 |
| 2010/0038089 | A1 | | 2/2010 | Gette et al. | |
| 2010/0147533 | A1 | * | 6/2010 | Nelson | 166/379 |
| 2011/0005774 | A1 | * | 1/2011 | Sinnott et al. | 166/380 |
| 2012/0261134 | A1 | * | 10/2012 | Silver | 166/368 |
| 2013/0000920 | A1 | * | 1/2013 | Duong | 166/368 |

OTHER PUBLICATIONS

Search Report from GB Application No. 12188889.5 dated Mar. 8, 2013.

* cited by examiner

CASING HANGER LOCKDOWN WITH CONICAL LOCKDOWN RING

BACKGROUND OF THE INVENTION

1. Field of the Invention

The present invention relates in general to wellhead casing hangers and, in particular, to a casing hanger lockdown slip ring that converts axial loads into radial loads.

2. Brief Description of Related Art

Seals are used between inner and outer wellhead tubular members to contain internal well pressure. The inner wellhead member may be a tubing hanger that supports a string of tubing extending into the well for the flow of production fluid. The tubing hanger lands in an outer wellhead member, which may be a wellhead housing, a Christmas tree, or a tubing head. A seal or packoff seals between the tubing hanger and the outer wellhead member. Alternately, the inner wellhead member might be a casing hanger located in a wellhead housing and secured to a string of casing extending into the well. A seal or packoff seals between the casing hanger and the wellhead housing.

A variety of seals of this nature have been employed in the prior art. Prior art seals include elastomeric and partially metal and elastomeric rings. Prior art seal rings made entirely of metal for forming metal-to-metal seals are also employed. The seals may be set by a running tool, or they may be set in response to the weight of the string of casing or tubing. One type of prior art metal-to-metal seal has inner and outer walls separated by a conical slot. An energizing ring is pushed into the slot to deform the inner and outer walls apart into sealing engagement with the inner and outer wellhead members. The energizing ring is a solid wedge-shaped member. The deformation of the inner and outer walls exceeds the yield strength of the material of the seal ring, making the deformation permanent.

Thermal growth between the casing or tubing and the wellhead may occur, particularly with wellheads located at the surface, rather than subsea. The well fluid flowing upward through the tubing heats the string of tubing, and to a lesser degree the surrounding casing. The temperature increase may cause the tubing hanger and/or casing hanger to move axially a slight amount relative to the outer wellhead member or each other. During the heat up transient, the tubing hanger and/or casing hanger can also move radially due to temperature differences between components and the different rates of thermal expansion from which the component materials are constructed. If the seal has been set as a result of a wedging action where an axial displacement of energizing rings induces a radial movement of the seal against its mating surfaces, then sealing forces may be reduced if there is movement in the axial direction due to pressure or thermal effects. A reduction in axial force on the energizing ring results in a reduction in the radial inward and outward forces on the inner and outer walls of the seal ring, which may cause the seal to leak. A loss of radial loading between the seal and its mating surfaces due to thermal transients may also cause the seal to leak.

Prior art apparatuses that attempt to overcome the problems caused by axial movement of the casing hanger or tubing hanger include lockdown seals. Lockdown seals require formation of a groove in the landing sub or wellhead during the manufacturing process. After the wellhead and landing sub are positioned within the wellbore, the lockdown seal is run to the location of the landing sub where a ring of the lockdown seal either expands or contracts into the groove formed into the wellhead or landing sub, respectively. Unfortunately, the groove often fills with debris prior to run-in of the lockdown seal. The debris prevents engagement of the ring and thus, provides no lockdown benefits of the lockdown seal result.

Lockdown seals require a significant increase in production costs. This is due in part to increased costs to modify the basic wellhead or landing sub to include the lock ring groove. In addition, the use of these devices necessitate use of specialized tools and other components to properly land and engage the lockdown seal. Furthermore, prior art lockdown seals require some clearance between the landing sub and the lockdown apparatus of the lockdown seal. This clearance allows the lockdown seal to land in the appropriate location relative to the wellhead and landing sub while also providing the necessary space for the lockdown portion of the seal to engage either the wellhead or the landing sub. The clearance also allows the landing sub to shift before the lockdown device properly engages and arrests movement of the landing sub. In such instances, the landing sub may shift axially and cause the seal to fail. Thus, there is a need for a lockdown seal that overcomes the problems in the prior art described above.

SUMMARY OF THE INVENTION

These and other problems are generally solved or circumvented, and technical advantages are generally achieved, by preferred embodiments of the present invention that provide a casing hanger lockdown slip ring, and a method for using the same.

In accordance with an embodiment of the present invention, a wellhead assembly is disclosed. The wellhead assembly includes a wellhead member defining a bore having a shoulder, the bore having a conical profile that decreases in diameter in an upward direction. The wellhead assembly also includes a hanger landed on the shoulder within the bore of the wellhead member and defining an annulus between the wellhead and the hanger. A hanger seal ring is disposed within the annulus, engaged with an inner surface of the wellhead, and engaged with an outer surface of the casing hanger so that the seal ring prevents flow through the annulus. A nose ring is secured to a lower end of the seal ring and has a conical surface that engages a conical profile in the bore of the wellhead member. The nose ring also engages an outer diameter surface portion of the casing hanger to limit upwards axial movement of the casing hanger.

In accordance with another embodiment of the present invention, a seal for sealing an annulus between inner and outer tubular members, wherein the inner tubular member is landed in a bore of the outer tubular member, is disclosed. The seal includes a seal ring adapted to land in the annulus and adapted to expand radially when energized to engage an inner diameter surface of the outer tubular member and an outer diameter surface of the inner tubular member. A lockdown assembly is secured to a lower end of the seal ring and having a conical surface that engages a conical profile the bore of the outer tubular member. The lockdown assembly also engages an outer diameter surface portion of the casing hanger to limit upwards axial movement of the casing hanger. The lockdown assembly has a neck on an upper end of the lockdown assembly, the neck having a groove on an outer diameter of the neck. The seal ring has a lower leg on a lower end of the seal ring, the lower leg having a recess on an inner diameter of the lower leg. A split ring is partially within the groove and partially within the recess, securing the lockdown slip ring to the seal ring.

In accordance with yet another embodiment of the present invention, a method for sealing a hanger to a wellhead member is disclosed. The method provides the wellhead member with a bore having a conical profile that decreases in diameter in an upward direction. The method lands the hanger in the wellhead member and defines an annulus between the hanger and the wellhead member, the hanger having an external shoulder at a lower end of the annulus. The method secures a nose ring to a lower end of a hanger seal, the nose ring having a conical surface. The method lands the hanger seal and nose ring in the annulus, and exerts a downward axial force on the hanger seal and pushing the nose ring against the shoulder of the hanger. The method engages the conical surface of the nose ring with the conical profile in the bore of the wellhead member and a surface of the nose ring opposite the conical surface with an outer diameter surface portion of the hanger. The method then energizes the seal to seal the annulus.

An advantage of a the disclosed embodiments is that they provide a lockdown seal that seals a casing hanger to a wellhead without requiring an extra trip to run the lockdown portion of the seal. In addition, the disclosed embodiments do not require clearance between the casing hanger and the lockdown portion of the seal in order to engage. Thus, the disclosed embodiments may provide lockdown capability that prevents axial motion of the casing hanger caused by high pressures and thermal expansion. Still further, the disclosed embodiments provide a lockdown seal that can still engage lockdown functions in the event the seal fails to land at the appropriate location or debris otherwise prevents lockdown.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning well drilling, running operations, and the like have been omitted in as much as such details are not considered necessary to obtain a complete understanding of the present invention, and are considered to be within the skills of persons skilled in the relevant art.

Figure 1:
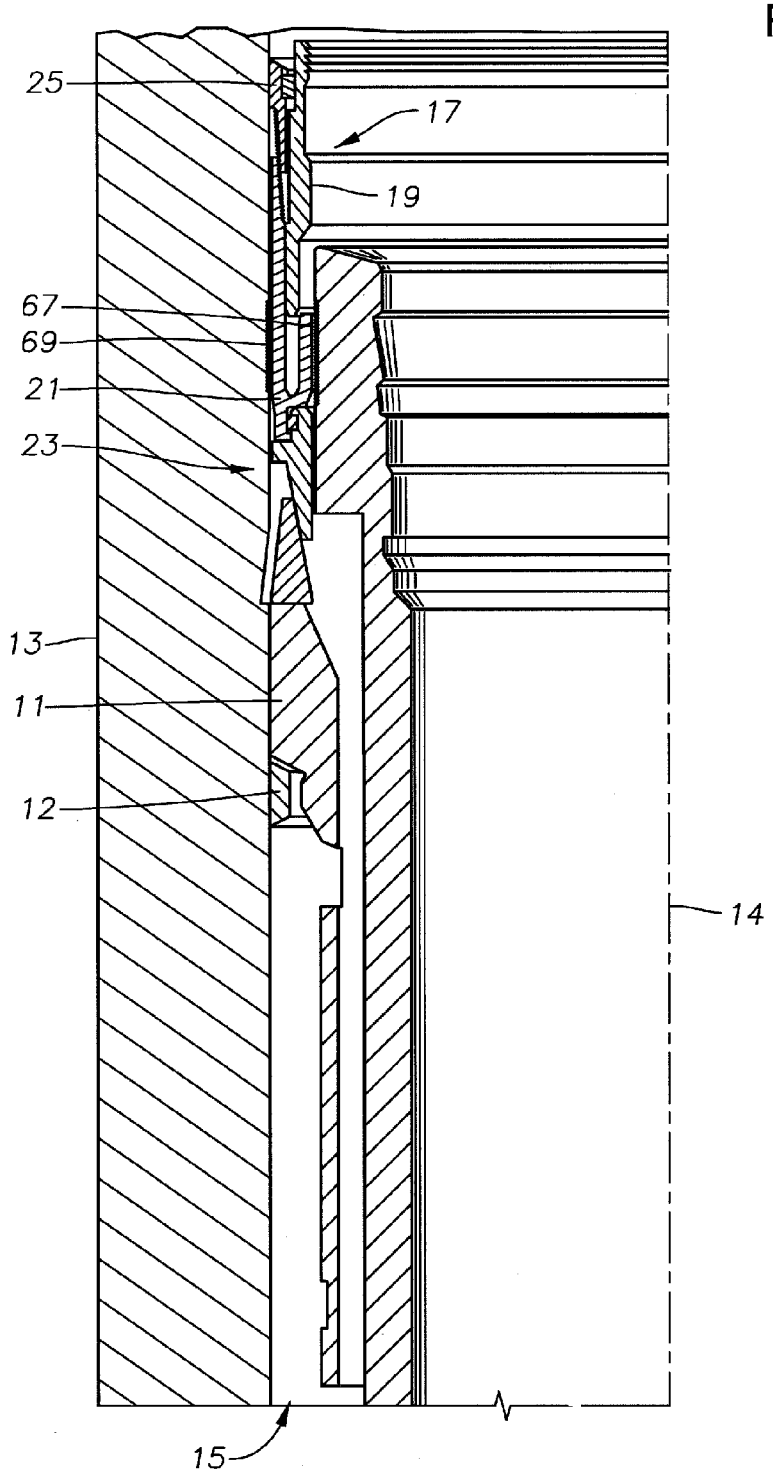
FIG. 1 is a vertical cross-sectional view of a casing hanger lockdown seal ring in accordance with an embodiment of the present invention disposed between a wellhead and a casing hanger.

Referring to FIG. 1, a casing hanger 11 having an axis 14 is shown disposed within a subsea wellhead 13. Generally, casing hanger 11 will land on a shoulder 12 formed in wellhead 13 to form an annulus 15 between casing hanger 11 and wellhead 13. In the illustrated embodiment, a portion of an exterior surface of casing hanger 11 contacts a portion of an interior surface of wellhead 13 at a shoulder 12. A person of ordinary skill in the art will understand that casing hanger 11 and wellhead 13 may be any inner and outer tubular members such that the inner tubular member may fit within a bore of the outer tubular member.

Figure 2:
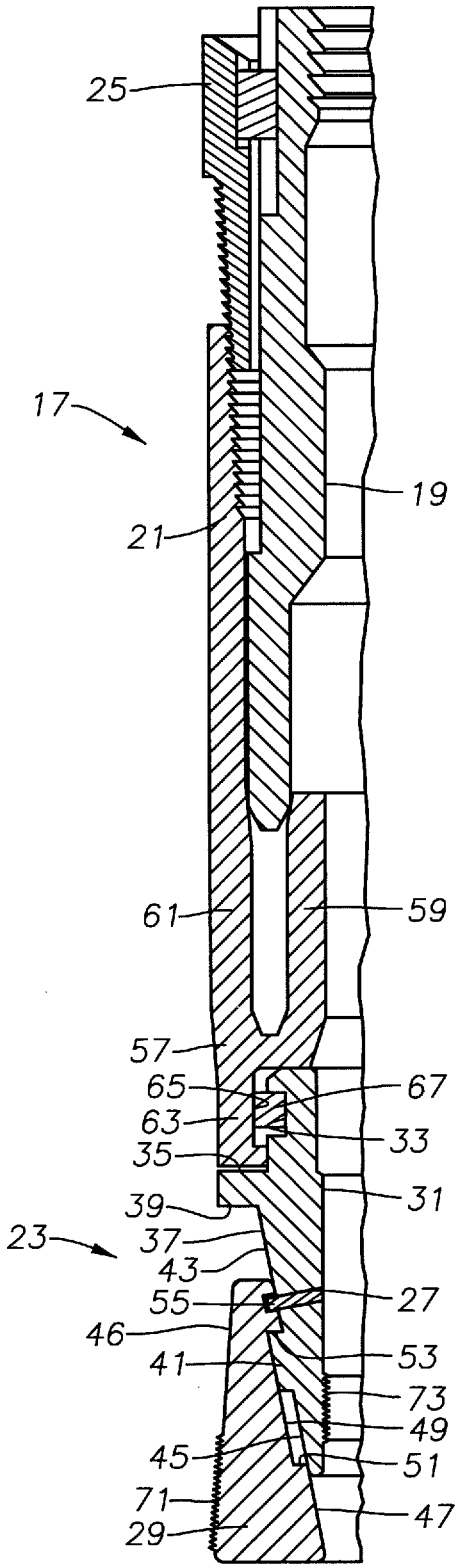
FIG. 2 is an enlarged vertical cross-sectional view of the casing hanger lockdown seal ring of FIG. 1, shown separate from the wellhead and casing hanger.
Figure 3:
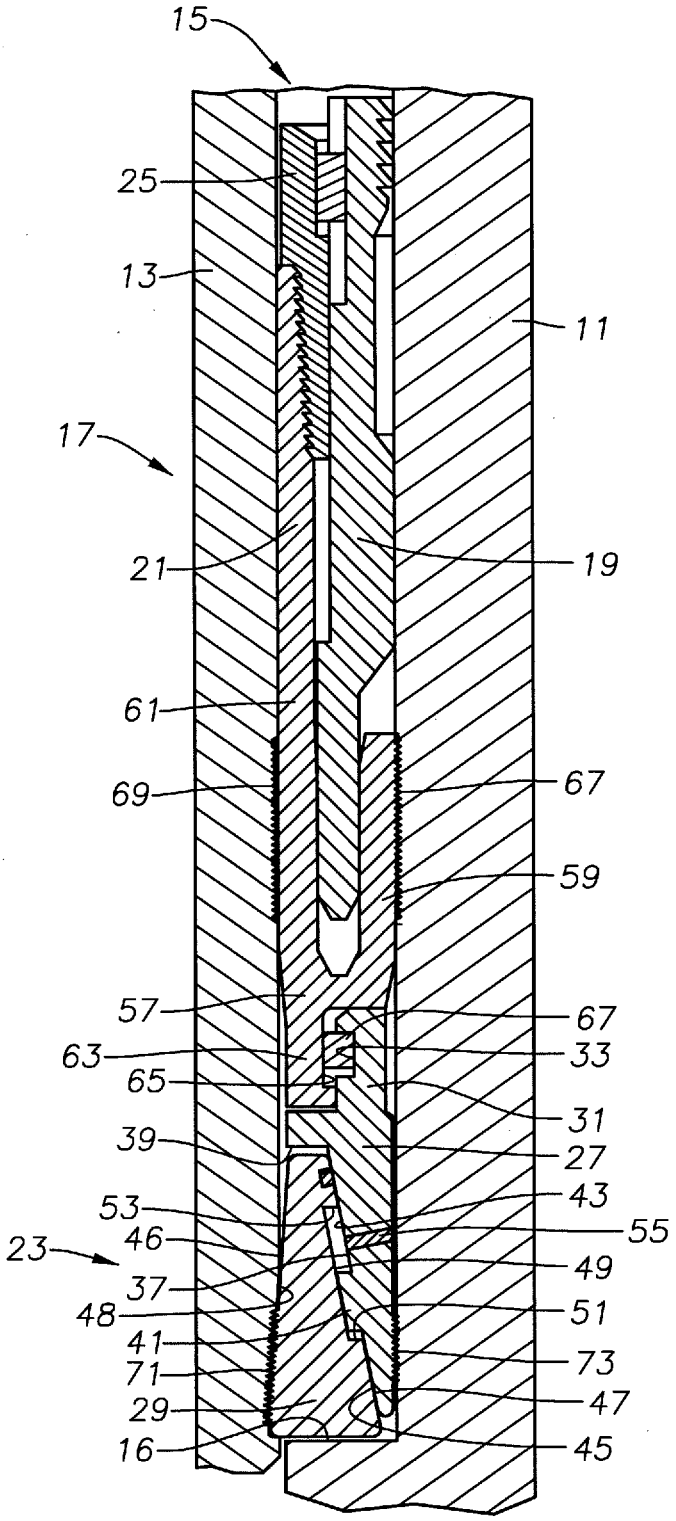
FIG. 3 is a vertical cross-sectional view of the lockdown seal ring as shown in FIG. 2, but energized within an annulus between the wellhead and the casing hanger.
Figure 4:
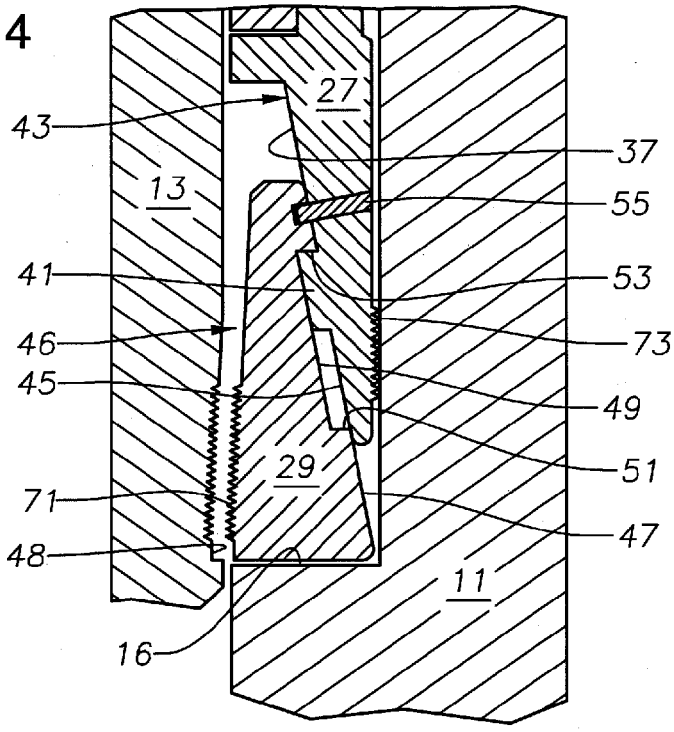
FIG. 4 is an enlarged vertical cross-sectional view of a portion of a lockdown slip ring of the seal ring as shown in FIG. 3, landed on the casing hanger, but no yet energized.

A casing hanger seal ring 17 is interposed between casing hanger 11 and wellhead 13. Casing hanger seal ring 17 substantially fills annulus 15 between casing hanger 11 and wellhead 13, sealing annulus 15 and setting casing hanger 11 to wellhead 13. Casing hanger seal ring 17 has an energized and an unenergized position. When in the energized position, as described in more detail with respect to FIGS. 3 and 5, casing hanger seal ring 17 will seal the annulus by engaging both the inner diameter surface of wellhead 13 and the outer diameter surface of casing hanger 11. When in the unenergized position, as shown in FIGS. 1, 2, and 4, casing hanger seal ring 17 may be run into the wellbore to land in annulus 15 between casing hanger 11 and wellhead 13, or pulled from annulus 15 between casing hanger 11 and wellhead 13. In the illustrated embodiment, casing hanger seal ring 17 includes an energizing ring 19, a seal ring 21, a lockdown slip ring 23, and a locking ring 25.

As shown in FIG. 2, lockdown slip ring 23 may comprise two annular rings, a coupling ring 27 and a slip ring 29. A person skilled in the art will understand that any suitable nose ring may be secured to seal ring 21 as described herein and may or may not include both coupling ring 27 and slip ring 29. The alternative nose rings will generally engage wellhead 13 as described in more detail below. In the illustrated embodiment, coupling ring 27 has a protrusion 31 at an upper end that defines a retaining groove or slot 33 in an outer diameter surface of protrusion 31. Groove 33 may be an annular groove or alternatively, groove 33 may extend only partway around the outer circumference of protrusion 31. Coupling ring 27 also defines an annular upward facing shoulder 35. Upward facing shoulder 35 extends from an outer diameter of coupling ring 27 to a base of protrusion 31. In the illustrated embodiment, upward facing shoulder 35 has a width that is approximately half the width of a cross section of coupling ring 27.

Figure 5:
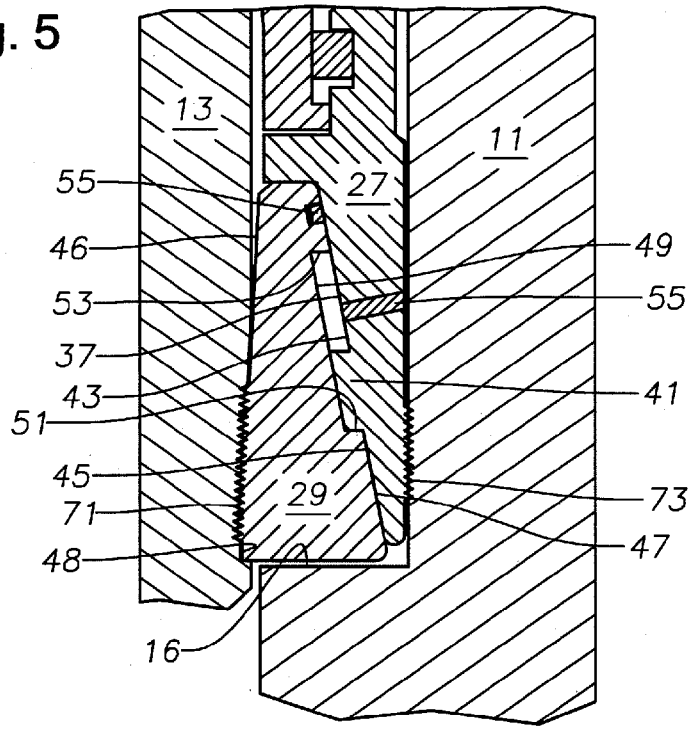
FIG. 5 is an enlarged vertical cross sectional view of the portion of the lockdown slip ring as shown in FIG. 4, but energized.

A lower end of coupling ring 27 has an approximately triangular shaped cross section having a substantially vertical surface forming the inner diameter of coupling ring 27. The substantially cylindrical surface extends from the lower end to a top of protrusion 31. The lower end of coupling ring 27 has a conical slip surface 37 extending from the lower end of coupling ring 27 to a downward facing shoulder 39 axially beneath upward facing shoulder 35. The diameter of conical slip surface 37 increases in an upward direction. A lower end of the inner diameter surface of coupling ring 27 may include wickers 73 that are adapted to engage a cylindrical outer diameter surface of casing hanger 11 as shown in FIG. 3 and FIG. 5. Wickers 73 may comprise gripping teeth or the like. Downward facing shoulder 39 extends from an outer diameter of coupling ring 27 to a base of or upper end of conical slip surface 37. A slip ring limiter 41 may protrude from a portion of conical slip surface 37 to define upper and lower coupling ring channels 43, 45, respectively. In the illustrated embodiment, slip ring limiter 41 is a band positioned approximately halfway between a lower end of coupling ring 27 and downward facing shoulder 39.

Slip ring 29 comprises a substantially trapezoidal shaped object in axial cross section having a conical outer surface 46 as shown in FIG. 4. Conical surface 46 decreases in diameter in an upward direction. An inner diameter of slip ring 29 comprises a conical slip surface 47 adapted to mate with conical slip surface 37 of coupling ring 27. A lower end of the conical surface 46 may include wickers 71 adapted to engage a mating conical profile 48 in the bore of wellhead 13. Wellhead profile 48, as shown in FIGS. 4 and 5, decreases in diameter in an upward direction. Wickers 71 may comprise gripping teeth or the like. A slip ring recess 49 is formed in conical slip surface 47 and extends into slip ring 29 from conical slip surface 47. Slip ring recess 49 is an annular recess adapted to receive slip ring limiter 41. As shown, slip ring 29 may slide axially relative to coupling ring 27 through slip ring recess 49. Slip limiter 41 will limit axial movement of slip ring 29 through contact with upward facing shoulder 51 of slip ring recess 49 and downward facing shoulder 53 of slip ring recess 49. Slip ring 29 may secure to coupling ring 27 with a shear element, such as shear retaining pin 55. Shear retaining pin 55 will prevent axial movement of slip ring 29 relative to coupling ring 27 during running of casing hanger 17.

Referring still to FIG. 2, seal ring 21 comprises an annular member having an approximately U-shaped cross section 57 with seal ring legs 59, 61 and a lower leg 63. Lower leg 63 extends downward from U-shaped cross section 57. Lower leg 63 has the same inner and outer diameter as outer leg 61 in this embodiment. Lower leg 63 extends past protrusion 31 of coupling ring 29 proximate to upward facing shoulder 35 of coupling ring 27. In the illustrated embodiment, the inner diameter of lower leg 63 defines a retainer recess 65 proximate to and facing groove 33. A retainer ring 67 may be interposed between lower leg 63 of seal ring 21 and protrusion 31 of coupling ring 27 such that retainer ring 67 substantially fills groove 33. A portion of retainer ring 67 will extend into retainer recess 65, causing coupling ring 27 to move axially in response to axial movement of seal ring 21. When thus positioned, the width of the combined protrusion 31 of coupling ring 27 and lower leg 63 of seal ring 21 is approximately equivalent to a width of seal ring 21 across the base of U-shaped cross section 57. Retainer ring 67 may be any suitable ring such as a split ring or the like. A person skilled in the art will recognize that prior to setting of casing hanger seal 17, there may be some axial movement of coupling ring 27 relative to seal ring 21. However, during and after setting of casing hanger seal 17, coupling ring 27 and seal ring 21 will act as one body.

Energizing ring 19 comprises a ring having an axially lower end slightly larger than the slot defined between seal ring legs 59, 61 of seal ring 21. Energizing ring 19 has an upper end adapted to be releasably coupled to a running tool so that the running tool may run casing hanger seal 17 to the location shown in FIG. 1, and then operate energizing ring 19 to energize casing hanger seal 17.

As described in more detail below, a running tool will apply an axial force to energizing ring 19, forcing energizing ring 19 axially into seal ring 21, providing an interference fit that will press seal ring legs 61, 59 of seal ring 21 into adjacent wickers 67 and 69 (FIG. 1 and FIG. 3). This will seal annulus 15 between casing hanger 11 and wellhead 13 at seal ring 21. A person skilled in the art will understand that the energizing ring 19 may be energized by a running tool or the like.

Referring now to FIG. 3, casing hanger seal 17 is run to land and set as shown in FIG. 3 in a typical running operation. While running into annulus 15, the elements of casing hanger seal 17 are as illustrated in FIG. 2. An axial force is then applied to energizing ring 19, such as with a running tool. Energizing ring 19 moves downward axially in response such that an end of energizing ring 19 applies a corresponding downward axial force to upper surfaces of seal ring legs 59, 61. Continued application of downward axial force to energizing ring 19 pushes a lower end of slip ring 29 into contact with upward facing shoulder 16 of casing hanger 11. Lockdown slip ring 23 is then axially compressed between seal ring 21 and upward facing shoulder 16 by energizing ring 19, causing shear pin 55 to shear. Coupling ring 27 will then move axially downward through slip recess 49. Eventually, a lower surface of slip retainer 41 may land against upward facing shoulder 51 of slip ring 29.

As shown in FIG. 5, downward movement of coupling ring 27 through slip recess 49 causes slip ring 29 to move radially into engagement with wellhead 13 in response. As slip ring 29 moves radially into wellhead 13, conical surface 46 will fit into a matching conical profile 48 formed in the inner diameter of wellhead 13. Wickers 71 will grip the surface of wellhead 13, holding slip ring 29 in engagement with wellhead 13. Similarly, wickers 73 will engage an outer diameter surface of casing hanger 11, holding coupling ring 27 in engagement with casing hanger 11. The outer diameter surface of casing hanger 11 engaged by coupling ring 27 is preferably cylindrical. Conical profile 48 of wellhead 13 may have mating wickers to wickers 71. The surface of coupling ring 27 engaged to the outer diameter of casing hanger 11 and conical surface 46 of slip ring 29 may have differing friction factors such that the surface of coupling ring 27 is more likely to slip relative to casing hanger 11 than conical surface 46 relative to wellhead profile 48. This may be achieved in any suitable manner such as by employing different types of wickers 71, 73 or teeth on the surfaces, by using a variety of friction gripping coatings, or the like. Also, because wellhead profile 48 and slip ring profile 46 are conical, slippage is less likely over he cylindrical engagement of wickers 73. A person skilled in the art will understand that both the surface of coupling ring 27 and conical surface 46 may include friction coatings, wickers, or the like. In other embodiments, the outer surface of casing hanger 11 may have mating wickers formed proximate to coupling ring 27 and wickers 73.

A person skilled in the art will recognize that conical surface 46 and conical profile 48 may be formed at matching angles. This allows for mating contact between conical surface 46 and conical profile 48 along any portion of the mating surfaces 46, 48. For example, casing hanger 11 and casing hanger seal 17 may not land appropriately such that, when energized, a lower portion of conical surface 46 of slip ring 29 may only engage an upper portion of conical profile 48 of wellhead 13. In another example, mating contact between conical surface 46 and conical profile 48 may still occur in the event debris is lodged or partially lodged within conical profile 48. Slip ring 29 may move axially a sufficient amount to engage conical surface 46 with a portion of conical profile 48.

In embodiments employing an alternative nose ring in place of lockdown slip ring 23, conical profile 48 and conical surface 46 will still be employed as described herein. The nose ring may be energized in any suitable manner so that conical surface 46 formed on a portion of the nose ring engages conical profile 48 of wellhead 13 as described above.

After slip ring 29 and coupling ring 27 are set, further downward axial movement of energizing ring 19 causes an end of energizing ring 19 to insert into the slot formed by seal ring legs 59, 61. As the end of energizing ring 19 inserts into the slot, seal ring legs 59, 61 will deform radially into engagement with wickers 67, 69, respectively, as shown in FIG. 3. The inner diameter surface of seal ring leg 59 will then be deformed by wickers 67 of casing hanger 11, and the outer diameter surface of seal ring leg 61 will be deformed by wickers 69 of wellhead 13, forming a seal of annulus 15.

During subsea operation of wellhead 13, thermal expansion of casing suspended from casing hanger 11, or fluid pressure within annulus 15 beneath casing hanger seal 17 may place an upward axial load on casing hanger 11. As casing hanger 11 attempts to move axially upward relative to wellhead housing 13 in response to such a load, casing hanger seal 17 will counteract this movement in the following manner. As casing hanger seal 11 attempts to move upward, it will transfer the upward axial load to slip ring 29 through upward facing shoulder 16. This upward axial load will urge slip ring 29 along the mating conical slip surfaces 47, 37 relative to coupling ring 27, transferring the upward axial load radially to press slip ring 29 into tighter radial engagement with conical profile 48 of wellhead 13. Thus, the upward axial loading will cause slip ring 29 to more tightly radially grip casing hanger 11 to wellhead 13 through casing hanger seal 17, preventing upward movement of casing hanger 11. Continued upward movement of slip ring 29 is prevented when upward facing shoulder 51 of slip ring 29 abuts slip limiter 41, thereby preventing further upward axial movement of casing hanger 11 and increasing the strength of the seal within annulus 15. In addition, conical surface 46 of slip ring 29 will fit more tightly within matching conical profile 48 of wellhead 13. This engagement preloads lockdown slip ring 23. Slip ring 23 is radially expanded and engaged in the wellhead 13, limiting any upward axial movement of casing hanger 11 when casing hanger seal 17 is energized. Thus, upward axial force applied to slip ring 29 by shoulder 16 of casing hanger 11 will urge slip ring 29 into tighter engagement with wellhead 13 through conical surface 46 and conical profile 48, providing additional lockdown capability that will prevent upward axial movement of casing hanger 11.

A person skilled in the art will understand that other embodiments casing hanger seal 17 may include a nose ring secured to seal ring 21 in a manner similar to lockdown slip ring 23. In these embodiments, conical profile 48 will still be formed in a bore of wellhead 13. The nose ring will include a matching conical portion similar to conical surface 46 that will engage conical profile 48 when casing hanger seal 17 is set or energized within annulus 15 between casing hanger 11 and wellhead 13. The nose ring may be any suitable nose ring allowing for set of casing hanger seal 17 between casing hanger 11 and wellhead 13 in annulus 15 and engagement of a conical surface of the nose ring with conical profile 48 of wellhead 13.

Accordingly, the disclosed embodiments provide a metal to metal seal that can land and seal an annulus between a casing hanger and a wellhead within a profile that accommodates some misplacement or debris within the profile without needing an additional trip to run a separate lockdown ring. Thus, there is no concern that debris may have landed on the shoulder or filled a dog recess that would prevent lock down of the seal. In addition, the disclosed embodiments provide a metal-to-metal seal with lockdown capability that increases the lockdown strength as pressure loading within the annulus beneath the seal increases. Furthermore, the metal seal disclosed herein eliminates the need for the seal to tolerate some axial shift before sealing; instead the seal preloads against a conical profile of the wellhead and prevents displacement of the casing hanger found in some cyclic loading, allowing the seal to operate for more cycles than in prior art designs.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A wellhead assembly comprising:

A wellhead member defining a bore having a shoulder, the bore having a conical profile that decreases in diameter in an upward direction;

A hanger landed on the shoulder within the bore of the wellhead member and defining an annulus between the wellhead member and the hanger;

A hanger seal ring for disposal within the annulus, and for engagement with an inner surface of the wellhead member, and an outer surface of the hanger so that the hanger seal ring prevents flow through the annulus; and A nose ring having first and second ring components, the nose ring for attachment to a lower end of the hanger seal ring, the first ring component having a conical surface for engagement with the conical profile in the bore of the wellhead member, and the second ring component for engagement with the hanger to limit upward axial movement of the hanger;

Wherein the first and second ring components are rigidly attached one to another by a shear element prior to engagement with the hanger and the conical profile in the bore of the wellhead member.

2. The wellhead assembly of claim 1, wherein at least a portion of the conical surface of the nose ring engages only a portion of the conical profile of the wellhead member.

3. The wellhead assembly of claim 1, wherein the nose ring is secured to the seal ring by a retaining ring.

4. The wellhead assembly of claim 3, further comprising:

a neck on an upper end of the nose ring, the neck having a groove on an outer diameter of the neck;

a lower leg on a lower end of the seal ring, the lower leg having a recess on an inner diameter of the lower leg; and wherein the retainer ring comprises a split ring interposed between the neck of the nose ring and the lower leg of the seal ring so that the retainer ring is partially within the groove and partially within the recess, securing the nose ring to the seal ring.

5. The wellhead assembly of claim 1, wherein:

The second ring component is a coupling ring secured to a lower end of the seal ring, the coupling ring having a coupling ring conical slip surface;

The first ring component is a slip ring having a slip ring conical slip surface abutting the conical slip surface of the coupling ring;

Wherein the conical surface is located on the slip ring opposite the conical slip surface; and Wherein axial movement of the slip ring relative to the coupling ring will cause the slip ring to slide along the coupling ring conical slip surface, thereby increasing a radial width of the slip ring.

6. The wellhead assembly of claim 5, wherein the slip ring is held in a first position relative to the coupling ring by the shear element.

7. The wellhead assembly of claim 5, wherein the coupling ring conical slip surface faces an inner diameter surface of the wellhead member.

8. The wellhead assembly of claim 5, wherein:

the coupling ring conical slip surface faces away from the casing hanger at an angle acute from the longitudinal axis of the wellbore; and the slip ring conical slip surface faces toward the casing hanger at an angle acute from the longitudinal axis of the wellbore.

9. The wellhead assembly of claim 5, wherein the second ring component is a coupling ring that further comprises wickers on a surface parallel to an axis of the coupling ring opposite the coupling ring conical slip surface so that the wickers engage a surface of the hanger; and the first ring component is a slip ring further that comprises wickers on the conical surface of the slip ring opposite the conical slip surface of the coupling ring so that the wickers engage the conical profile of the bore of the wellhead member.

10. A seal for sealing an annulus between inner and outer tubular members, wherein the inner tubular member is landed in a bore of the outer tubular member, the seal comprising:

A seal ring adapted to land in the annulus and adapted to expand radially when energized to engage an inner diameter surface of the outer tubular member and an outer diameter surface of the inner tubular member;

A lockdown assembly having first and second ring components, the lockdown assembly for attachment to a lower end of the seal ring, the first ring component and having a conical surface for engagement with a conical profile of the bore of the outer tubular member;

The second ring component for engagement with an outer diameter surface portion of the inner tubular member to limit upwards axial movement of the inner tubular member;

Wherein the first and second ring components are rigidly attached to one another by a shear element prior to engagement with the inner tubular member and the conical profile in the bore of the outer tubular member;

The lockdown assembly having a neck on an upper end of the lockdown assembly, the neck having a groove on an outer diameter of the neck;

The seal ring having a lower leg on a lower end of the seal ring, the lower leg having a recess on an inner diameter of the lower leg; and Wherein a split ring is partially within the groove and partially within the recess, securing the lockdown assembly to the seal ring.

11. The seal of claim 10, wherein at least a portion of the conical surface of the lockdown assembly engages only a portion of the conical profile of the outer tubular member.

12. The seal of claim 10, wherein:

The second ring component is a coupling ring secured to a lower end of the seal ring, the coupling ring having a coupling ring conical slip surface;

The first ring component is a slip ring having a slip ring conical slip surface abutting the conical slip surface of the coupling ring, the slip ring held in a first position relative to the coupling ring by the shear element; and The slip ring secured to the coupling ring so that axial movement of the slip ring causing shear of the shear element will cause the slip ring to slide along the conical slip surface of the coupling ring, thereby increasing a radial width of the slip ring.

13. The seal of claim 12, wherein the first ring component of the slip is adapted to engage an inner diameter surface of the outer tubular member.

14. The seal of claim 12, wherein:

the coupling ring further comprising wickers on a surface parallel to an axis of the coupling ring opposite the coupling ring conical slip surface so that the wickers engage the inner tubular member; and the slip ring further comprising wickers that engage the conical profile of the outer tubular member.

15. A method for sealing a hanger to a wellhead member, comprising:

(a) providing the wellhead member with a bore having a conical profile that decreases in diameter in an upward direction;

(b) landing the hanger in the wellhead member, defining an annulus between the hanger and the wellhead member, the hanger having an external shoulder at a lower end of the annulus;

(c) securing a nose ring to a lower end of a hanger seal, the nose ring having first and second ring components attached to one another by a shear element, the first ring component having a conical surface;

(d) landing the hanger seal and nose ring in the annulus;

(e) exerting a downward axial force on the hanger seal and pushing the first ring component against the shoulder of the hanger to break the shear element so that the first and second ring components can move relative to one another;

(f) engaging the conical surface of the first ring component with the conical profile in the bore of the wellhead member and engaging a surface of the second ring component with the hanger; and (g) energizing the hanger seal to seal the annulus.

16. The method of claim 15, further comprising wickers on the inner and outer diameters of the nose ring, wherein, in the event the hanger moves axially upward, step (d) comprises moving the nose ring of the hanger seal radially into tighter engagement with a conical profile of the wellhead member by engaging the wickers on the inner and outer diameter surfaces of the nose ring with the hanger and wellhead member.

17. The method of claim 15, wherein, the first and second ring components are moveable axially between contracted and extended positions:

wherein step (c) comprises securing the first and second ring components in the extended position with a shear element; and wherein step (f) comprises shearing the shear element to cause the first and second ring components to move toward the contracted position.

18. The method of claim 17, wherein step (e) results in the nose ring increasing in radial width.

19. The method of claim 15, wherein a frictional engagement of the nose ring and wellhead member is greater than a frictional engagement of the nose ring and the hanger.

20. The method of claim 15, wherein expansion of the hanger relative to the wellhead member causes the shoulder of the hanger to push upward on the nose ring, which is resisted by the conical profile in the bore of the wellhead member.

* * * * *